US005375661A

United States Patent [19]

Daneshy et al.

[11] Patent Number: 5,375,661

[45] Date of Patent: Dec. 27, 1994

[54] WELL COMPLETION METHOD

[75] Inventors: Abbas A. Daneshy, Leiden, Netherlands; David D. Szarka, Duncan, Okla.

[73] Assignee: Halliburton Company, Duncan, Okla.

[21] Appl. No.: 136,512

[22] Filed: Oct. 13, 1993

[51] Int. Cl.[5] ..... E21B 43/04; E21B 33/00

[52] U.S. Cl. ..... 166/278; 166/285

[58] Field of Search ..... 166/276, 278, 292–296, 166/222, 285, 373

[56] References Cited

U.S. PATENT DOCUMENTS

| | | | |
|---|---|---|---|
| 2,083,625 | 6/1937 | White | 166/21 |
| 2,597,554 | 5/1952 | West | 166/20 |
| 4,046,198 | 9/1977 | Gruesbeck et al. | 166/278 |
| 4,160,674 | 7/1979 | Sawyer | 106/713 |
| 4,402,551 | 9/1983 | Wood et al. | 166/285 X |
| 4,553,595 | 11/1985 | Huang et al. | 166/278 |
| 4,665,988 | 5/1987 | Murphey et al. | 166/295 |
| 4,714,117 | 12/1987 | Dech | 166/380 |
| 4,761,183 | 8/1988 | Clarke | 106/714 |
| 4,869,323 | 9/1989 | Stagg | 166/285 |
| 4,899,821 | 2/1990 | Casida | 166/222 |
| 4,917,188 | 4/1990 | Fitzpatrick, Jr. | 166/295 |
| 4,921,047 | 5/1990 | Summers et al. | 166/276 |
| 4,949,788 | 8/1990 | Szarka et al. | 166/285 |
| 4,969,523 | 11/1990 | Martin et al. | 166/278 |
| 4,972,906 | 11/1990 | McDaniel | 166/276 |
| 4,979,561 | 12/1990 | Szarka | 166/240 |
| 5,029,644 | 7/1991 | Szarka et al. | 166/223 |
| 5,058,676 | 10/1991 | Fitzpatrick et al. | 166/278 |
| 5,083,614 | 1/1992 | Branch | 166/278 |
| 5,086,850 | 2/1992 | Harris et al. | 175/61 |
| 5,090,478 | 2/1992 | Summers | 166/295 X |
| 5,095,987 | 3/1992 | Weaver et al. | 166/276 |
| 5,128,390 | 7/1992 | Murphey et al. | 523/130 |
| 5,301,760 | 4/1994 | Graham | 166/285 X |

*Primary Examiner*—Ramon S. Britts
*Assistant Examiner*—Frank S. Tsay
*Attorney, Agent, or Firm*—Robert A. Kent; Dennis D. Brown

[57] ABSTRACT

A well completion method comprising the steps of: (1) positioning a conduit in a wellbore such that (a) a wellbore annulus surrounding the conduit is defined between the conduit and the wall of the wellbore, (b) the wellbore annulus has a first longitudinal segment which is positioned within a producing formation, (c) the wellbore annulus has a second longitudinal segment which is positioned within a producing formation, and (d) the wellbore annulus has a third longitudinal segment which is positioned between the first longitudinal segment and the second longitudinal segment; (2) placing a gravel pack in the wellbore annulus such that the gravel pack surrounds the conduit and substantially fills the first, second, and third longitudinal segments of the wellbore annulus; and (3) injecting a hardenable hydraulic cement composition into the portion of the gravel pack located in the third longitudinal segment of the wellbore annulus such that, after the hydraulic cement composition hardens, the third longitudinal segment of the wellbore annulus is blocked and fluid flow through the third longitudinal segment of the wellbore annulus from the first longitudinal segment to the second longitudinal segment and from the second longitudinal segment to the first longitudinal segment is thereby substantially prevented.

20 Claims, 1 Drawing Sheet

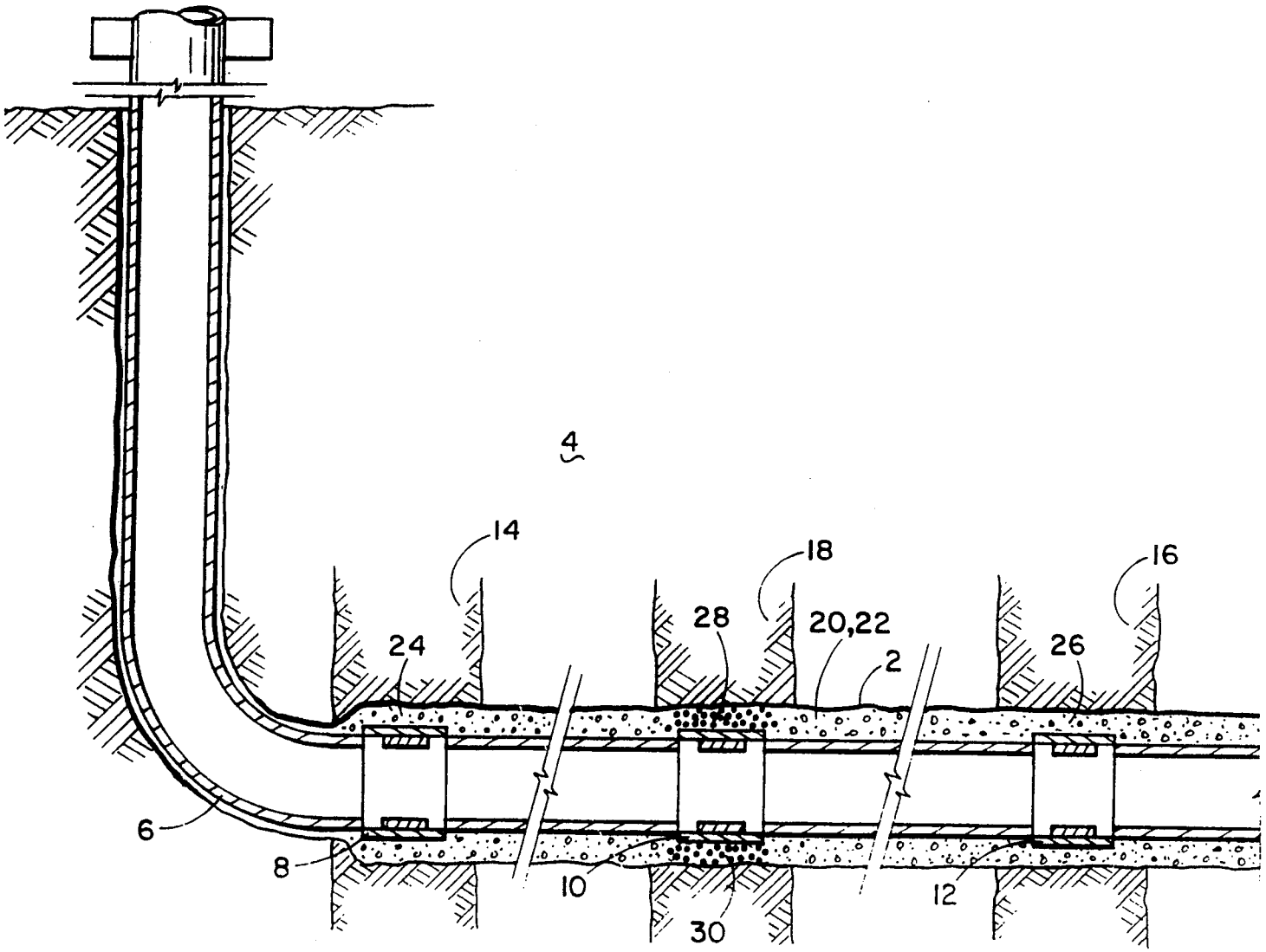
16
26
12
2
20,22
18
28
30
10
4
14
24
8
6

WELL COMPLETION METHOD

FIELD OF THE INVENTION

The present invention relates to well completion methods. More particularly, but not by way of limitation, the present invention relates to methods of completing horizontal or other high deviation wells such that the wells are provided with multiple production intervals.

BACKGROUND OF THE INVENTION

When completing a horizontal or other high deviation well, several zones of interest are typically completed per horizontal or highly deviated lateral, even though at least some of these zones lie within a single geological formation. A horizontal lateral, for example, can desirably be divided into isolatable longitudinal segments which correspond to substantially separate, naturally fractured regions existing in the subterranean formation through which the horizontal lateral extends. Additionally, a horizontal lateral can be divided into isolatable longitudinal segments in order to separate producing regions from shale streaks or other natural obstructions extending into the formation.

Several advantages can be obtained by dividing a horizontal or other highly deviated lateral into separate isolatable segments wherein each segment is associated with a different zone of interest. For example, by dividing a well lateral in this manner, stimulation treatments can be individually and separately directed to specific zones of interest. Consequently, such stimulation treatments can be conducted in a much more effective and efficient manner. Additionally, the division of a well lateral into separate isolatable segments (a) allows individual zones of interest to be selectively tapped for production, (b) allows nonproductive regions to be readily isolated from producing zones, and (c) allows gassed out and/or watered out zones to be quickly identified and isolated from zones which are producing substantially less gas and/or water.

U.S. Pat. No. 4,949,788 discloses a method of completing a horizontal well wherein a casing string including a plurality of casing valves is cemented in a wellbore. Each casing valve includes (a) an outer housing with a plurality of ports defined through the wall thereof and (b) a sliding sleeve received in the housing and including a plurality of sleeve ports. After the casing string is cemented in the formation, a fracturing tool including a casing valve positioner is run into the casing string. The casing valve positioner is operable for opening and closing the casing valves. Using the fracturing tool string, the formation is fractured by sequentially opening each of the casing valves and pumping a fracturing fluid therethrough. Following the fracturing procedure, a production tubing string is placed in the casing and is used to produce formation fluids from selected formation zones.

The completion method of U.S. Pat. No. 4,949,788 allows individual zones of interest to be selectively isolated and opened by operating the appropriate casing valves. However, even when supplemental fracturing or other stimulation procedures are used, completion methods of the type disclosed in U.S. Pat. No. 4,949,788 (i.e., methods wherein cement sheaths are placed across naturally producing formations) typically substantially reduce the production rates obtainable from the naturally producing formations.

U.S. Pat. No. 4,714,177 discloses a method for completing a horizontal well which utilizes a casing string composed of alternating casing valves and casing packers. When expanded in the wellbore, each of the casing packers forms a seal between the exterior of the casing string and the wellbore wall. Consequently, the casing packers operate to isolate discrete segments of the horizontal lateral to thereby allow localized production and remedial treatments.

Unfortunately, methods of the type described in U.S. Pat. No. 4,714,117 are somewhat unreliable. Casing packers can be easily damaged while the casing string is being run into the wellbore. Consequently, casing packer systems typically have undesirably high failure rates.

U.S. Pat. No. 4,972,906 discloses a method for treating a gravel packed vertical well wherein the entire lowermost portion of the vertical well is plugged. The method of U.S. Pat. No. 4,972,906 is particularly applicable for sealing off water-producing segments of gravel packed wells. In the method of U.S. Pat. No. 4,972,906, an epoxy resin composition is placed in the gravel packing liner at a spot above the location where water entry is occurring. The epoxy resin flows through the slotted and/or screened liner and into the gravel pack. A sufficient amount of epoxy resin composition is preferably deposited in the well liner to fill and plug the gravel pack up to a point above the uppermost point of water entry.

U.S. Pat. No. 5,086,850 discloses a method for terminating water flow through a gravel pack contained in a vertical well. The method of U.S. Pat. No. 5,086,850 utilizes a cement slurry wherein the diameters of the cement particles contained in the slurry are not greater than about 30 microns. As with the method of U.S. Pat. No. 4,972,906, the method of U.S. Pat. No. 5,086,850 operates to plug off the entire lowermost portion of the vertical well. In the method of U.S. Pat. No. 5,086,850, a sufficient amount of cement slurry is placed in the gravel packing liner to saturate the portion of the gravel pack through which water production is occurring. A sufficient pressure is then applied against the slurry to force the slurry into the gravel pack and at least partially into the subterranean formation from which the water is being produced. Hydraulic pressure is maintained against the slurry for a time sufficient to ensure that the slurry remains in and hardens in the gravel pack.

As is apparent, neither U.S. Pat. No. 4,972,906 nor U.S. Pat. No. 5,086,850 provides a method wherein a casing liner or other conduit is secured and supported in a horizontal or other highly deviated wellbore. Additionally, these patent disclosures do not provide methods whereby multiple production zones in either a vertical or highly deviated lateral can be effectively separated and isolated.

Thus, a need presently exists for a reliable completion method which: (a) can be effectively used in horizontal and other highly deviated wellbores; (b) will not substantially reduce the production rates obtainable from naturally producing formations; (c) will provide a desirable degree of casing support; and (d) will allow individual zones of interest to be quickly and effectively isolated and/or opened.

SUMMARY OF THE INVENTION

The present invention provides a well completion method which substantially alleviates the problems and satisfies the needs discussed hereinabove. The inventive method comprises the steps of: (1) positioning a conduit in a wellbore such that (a) a wellbore annulus surrounding the conduit is defined between the conduit and the wall of the wellbore, (b) the wellbore annulus has a first longitudinal segment which is positioned within a producing formation, (c) the wellbore annulus has a second longitudinal segment which is positioned within a producing formation, and (d) the wellbore annulus has a third longitudinal segment which is positioned between the first longitudinal segment and the second longitudinal segment; (2) placing a gravel pack in the wellbore annulus such that the gravel pack surrounds the conduit and substantially fills the first, second, and third longitudinal segments of the wellbore annulus; and (3) injecting a hardenable hydraulic cement composition into the portion of the gravel pack located in the third longitudinal segment of the wellbore annulus. After the hydraulic cement composition hardens, the third longitudinal segment of the wellbore annulus is blocked and fluid flow through the third longitudinal segment of the wellbore annulus from the first longitudinal segment to the second longitudinal segment and from the second longitudinal segment to the first longitudinal segment is thereby substantially prevented.

The hardenable cement composition used in step (3) of the inventive method is preferably a slurry comprising water and at least one hydraulic cement material. Additionally, each hydraulic cement material included in the slurry preferably consists essentially of particles having diameters not exceeding about 30 microns. Further, the gravel packing step (i.e., step (2)) of the inventive method preferably includes the steps of: (a) placing a consolidatable gravel packing composition comprising a particulate material coated with a hardenable resin composition in the wellbore annulus such that the consolidatable gravel packing composition substantially fills the first, second, and third longitudinal segments of the wellbore annulus and (b) prior to step (3), allowing the hardenable epoxy resin composition to harden such that the consolidatable gravel packing composition forms a hard permeable mass.

Although the inventive method can generally be used in any type of well (i.e., vertical wells or highly deviated wells), the inventive method is particularly well-suited for use in horizontal or other highly deviated wells. The inventive method is also particularly well-suited for use in naturally producing formations.

As used herein, the term "highly deviated" refers generally to any wellbore which is intentionally drilled in a non-vertical manner.

Further objects, features, and advantages of the present invention will be apparent to those skilled in the art upon reference to the accompanying drawing and upon reading the following description of the preferred embodiments.

BRIEF DESCRIPTION OF THE DRAWING

The drawing provides a schematic view of a horizontal wellbore completed in accordance with the method of the present invention.

DESCRIPTION OF THE PREFERRED EMBODIMENTS

The accompanying drawing schematically depicts a horizontal well which has been completed in accordance with the method of the present invention. The completed well includes a horizontal wellbore 2 which extends a substantial distance into a subterranean formation 4. A casing string 6, or other conduit, including casing valves 8, 10, and 12 is positioned in wellbore 2 such that (a) casing valve 8 lies within a first producing zone 14 of formation 4, (b) casing valve 12 lies within a second producing zone 16 of formation 4, and (c) casing valve 10, which is positioned in casing string 6 between valves 8 and 12, lies within a third zone 18 of formation 4.

Casing string 6 is held and supported in horizontal wellbore 2 by means of a hard, consolidated, gravel pack 20 which has been placed in the annulus 22 existing between casing string 6 and the wall of horizontal wellbore 2. A first longitudinal segment 24 of annulus 22 and of gravel pack 20 lies within first producing zone 14 of formation 4. A second longitudinal segment 26 of annulus 22 and of gravel pack 20 lies within second producing zone 16 of formation 4. A third longitudinal segment 28 of annulus 22 and of gravel pack 20 lies within third zone 18 of formation 4.

Segments 24 and 26 of gravel pack 20 are hard, permeable segments which (a) will allow the flow of formation fluids from producing zones 14 and 16 of formation 4 to casing string and (b) will allow the flow, as desired or as necessary, of stimulation fluids or other fluids from casing valves 8 and/or 12 to producing zones 14 and/or 16.

Segment 28 of gravel pack 20, on the other hand, has been filled with a hydraulic cement material 30. Hydraulic cement material 30 has hardened in segment 28 of gravel pack 20 such that segment 28 of annulus 22 is effectively blocked. Consequently, the hardened cement material operates to substantially prevent fluid flow from occurring through segment 28 of annulus 22 from either of segments 24 and 26 of annulus 22 to the other of segments 24 and 26 of annulus 22.

Although generally any type of casing valve can be used in the present invention, each of casing valves 8, 10, and 12 preferably comprises: (a) an outer housing having a plurality of ports defined through the wall thereof and (b) a sliding sleeve received in the housing and including a plurality of sleeve ports. An example of a casing valve suitable for use in the present invention is disclosed in U.S. Pat. No. 4,949,788. The entire disclosure of U.S. Pat. No. 4,949,788 is incorporated herein by reference. U.S. Pat. No. 4,949,788 also discloses a valve positioner which is well-suited for use in selectively operating (i.e., opening and closing) casing valves of the type disclosed in the patent.

Since segment 28 of annulus 22 is effectively blocked by the presence of the hardened cement material 30, producing zones 14 and 16 can be easily isolated from each other and from casing string 6 by selectively operating casing valves 8 and 12.

Although only two producing zones 14 and 16 are depicted in the drawing, it will be understood that any number of producing zones can be effectively completed and isolated using the inventive method by providing an appropriate number of properly positioned casing valves in the casing string and, preferably, by placing a cement plug 30 between each pair of producing zones.

It will also be understood that, as an alternative to the use of casing valves 8 and 12, other means can be used to establish fluid communication between casing string 6 and producing zones 14 and 16. For example, portions of casing string 6 lying within producing zones 14 and 16 can be perforated using conventional perforating procedures. An example of a method for perforating a gravel packed conduit so that the conduit is placed in fluid communication with a producing formation is disclosed in U.S. Pat. No. 4,917,188, the entire disclosure of which is incorporated herein by reference.

It is noted, however, that, in contrast to the use of casing valves, casing systems utilizing perforations or other such "permanent" casing openings do not provide separable production zones which can be selectively accessed and isolated in a quick and convenient manner (e.g., by the simple operation of a valve).

U.S. Pat. No. 4,917,188 also discloses a stimulation procedure which can be used in conjunction with the present invention wherein a formation is fractured by pumping a fracturing fluid through a set of casing perforations, through a gravel pack, and into the formation. Alternatively, when casing valves 8 and 12 are used, a similar fracturing technique can be employed wherein the fracturing fluid is pumped through either or both of casing valves 8 and 12.

Gravel pack 20 is preferably a consolidated gravel pack which has been formed from a particulate material having a hardenable resin composition deposited thereon. The particulate material used in forming gravel pack 20 can generally be any type of material which is used in the art for gravel packing. Examples include: sand; glass beads; nut shells; metallic pellets or spheres; gravel; synthetic resin pellets or spheres; coke; and like materials; The gravel packing particulate material preferred for use in the present invention is sand.

The particulate material used for forming gravel pack 20 will preferably consist essentially of particles having sizes smaller than about 20 mesh. The smaller packing material preferred for use in the present invention provides a greater degree of casing support. Additionally, if a particulate material larger than about 12 mesh is used, the pore spaces existing between the individual particles of the packed bed will typically be large enough to allow the wet hydraulic cement material 30 to settle to the bottom of the packed bed. Consequently, if a particulate material larger than about 12 mesh is used, the cement material 30 injected into segment 28 of gravel pack 20 will tend to settle to the bottom of horizontal annulus 22 rather than remaining in and filling the entire segment 28.

In order to provide desirable permeability for product recovery and for cement injection, the particulate material used in forming gravel pack 20 will also preferably consist essentially of particles having sizes larger than about 60 mesh.

The particulate material most preferred for use in forming gravel pack 20 is 20/40 mesh Ottawa sand.

Examples of hardenable resin compositions suitable for use in forming consolidated gravel pack 20, as well as methods for forming such compositions, are disclosed in U.S. Pat. Nos. 4,665,988 and 5,128,390. The entire disclosures of these patents are incorporated herein by reference. Hardenable resin compositions of the type disclosed in U.S. Pat. Nos. 4,665,988 and 5,128,390 comprise one or more epoxy resins and one or more hardening agents. Examples of other ingredients commonly used in such compositions include: solvents; coupling agents; surfactants; and hardening rate controllers.

The hardenable resin composition is used in an effective amount for consolidating the gravel pack particulate material to form a hard, permeable mass. A hardenable resin composition of the type disclosed in U.S. Pat. Nos. 4,665,988 and 5,128,390 will typically be used in an amount providing in the range of from about 1 to about 20 pounds of resin composition per each 100 pounds of particulate material.

The wet hydraulic cement material 30 used for filling and blocking segment 28 of gravel pack 20 is preferably a slurry composed of water and a particulate hydraulic cement material. The particle size of the hydraulic cement material is sufficiently small to enable the cement material to travel through and fill the pore spaces of gravel pack 20. The particulate hydraulic cement material preferably consists essentially of particles having diameters no larger than about 30 microns. More preferably, the particulate hydraulic cement material consists essentially of particles having diameters not exceeding about 17 microns. Most preferably, the particulate hydraulic cement material consists essentially of particles having diameters not exceeding about 11 microns.

The particulate hydraulic cement material used in the present invention is also preferably composed of either Portland cement or a combination of Portland cement and slag cement. The amount of Portland cement contained in the particulate hydraulic cement material is preferably at least about 40% by weight based on the total dry weight of the cement material. More preferably, the amount of Portland cement contained in the dry cement material is at least about 60% by weight. Still more preferably, the amount of Portland cement contained in the dry cement material is at least about 80% by weight. Most preferably, the amount of Portland cement contained in the dry cement material is about 100% by weight.

The amount of water contained in the hydraulic cement slurry will be an effective amount for allowing the slurry to be delivered downhole and injected into segment 28 of gravel pack 20. The weight ratio of water to particulate cement material contained in the slurry will preferably be a value in the range of from about 0.5 to about 5.0. In order to avoid the occurrence of excessive water separation and solids settling while providing sufficient particle wetting and slurry flowability, the hydraulic cement slurry will more preferably have a water to dry cement weight ratio in the range of from about 1.0 to about 1.75. Most preferably, the cement slurry will have a water to dry cement weight ratio in the range of from about 1.0 to about 1.5.

In addition to the other advantages discussed hereinabove, finely-divided Portland cement materials of the type used herein tend to provide a desirable degree of expansion during the cement setting processes. This expansion contributes to the achievement of a more complete blockage of the gravel pack pore spaces.

Particulate cement materials suitable for use in the present invention, as well as methods for preparing such particulate cement materials, are disclosed, for example, in U.S. Pat. Nos. 4,160,674 and 4,761,183. Further, particulate cement materials, particulate cement slurries, and particulate cement slurry additives suitable for use in the present invention are disclosed in U.S. Pat. No. 5,086,850. The entire disclosures of U.S. Pat. Nos.

4,160,674, 4,761,183, and 5,086,850 are incorporated herein by reference.

In the method of the present invention, horizontal wellbore 2 can optionally be underreamed in order to remove drilling mud cake and other debris from the wall of the wellbore and to otherwise open up the wall of the wellbore for production. Underreaming also allows the placement of a greater quantity of gravel packing material in the wellbore for, e.g., better sand control and better casing support. If horizontal wellbore 2 is underreamed, a mechanical underreaming tool is preferably used. Underreaming methods and mechanical underreaming tools suitable for use in conjunction with the present invention are disclosed, for example, in U.S. Pat. No. 4,917,188. The entire disclosure of U.S. Pat. No. 4,917,188 is incorporated herein by reference.

Casing string 6 including casing valves 8, 10, and 12 is run into wellbore 2 such that valves 8, 10, and 12 are positioned in formation zones 14, 16, and 18 as described hereinabove and as depicted in the drawing. As will be understood by those skilled in the art, casing string 6 is preferably centered in wellbore 2 using appropriately spaced casing centralizers. Since wellbore 2 is a horizontal wellbore rather than a vertical wellbore, casing string 6 is preferably centered in wellbore 2 using rigid casing centralizers rather than bow spring-type centralizers. Centering casing string 6 in horizontal wellbore 2 helps to ensure that (a) casing string 6 extends substantially through the center of wellbore 2 rather than lying on the bottom of wellbore 2 so that (b) casing string 6 will be entirely encased and supported by gravel pack 20.

Although the consolidatable, resin coated, particulate material which forms gravel pack 20 can be placed in annulus 22 by pumping the material through casing valves 8, 10, and 12, the gravel packing material is preferably pumped out of the distal end of casing string 6 so that the material flows back through the wellbore annulus and thereby fills annulus segments 24, 26, and 28. In order to allow the resin coated gravel packing material to be pumped down the casing string and into the wellbore annulus, the gravel packing material is preferably suspended in a gelled aqueous carrier fluid or in some other type of fluid carrier medium.

Examples of general gravel packing methods, gravel packing carrier fluids, carrier-suspended gravel packing compositions, and methods for preparing such compositions are disclosed in U.S. Pat. Nos. 4,665,988, 4,917,188, and 5,128,390.

When the gravel packing material is in place in annulus 22, the resin material is allowed to harden. The hardening of the resin material consolidates the gravel packing material to thereby yield a hard, permeable mass.

A quantity of the above-described cement slurry sufficient to fill segment 28 of gravel pack 20 is then injected into segment 28 through casing valve 10. This injection procedure preferably includes the steps of: placing a bridge plug in casing string 6 near the downhole end of casing valve 10; running a tubing string, including a packer and a positioning tool, into casing string 6; using the positioning tool to open casing valve 10; pumping cement slurry to the approximate distal end of the tubing string; setting the packer near the uphole end of casing valve 10 so that valve 10 is isolated between the packer and the bridge plug; pumping additional cement slurry through the tubing string so that the cement slurry flows out of casing valve 10 and into segment 28 of gravel pack 20; pressuring up the annulus between the tubing string and the interior wall of the casing so that the cement slurry will be prevented from flowing into the casing/tubing annulus when the packer is unseated; unseating the packer; closing casing valve 10 using the positioning tooling; and removing any cement material remaining in the tubing string and in the interior of casing valve 10 by reverse circulating a fluid down through the casing/tubing annulus and up through the interior of the tubing string.

In those situations wherein more than one gravel packed segment is to be plugged with cement material, the above-described cement injection procedure will preferably be applied to the segments in a sequential manner beginning with the furthermost segment to be treated and ending with the segment closest to the well head.

After the cement composition hardens in segment 28 of gravel pack 20, casing valves 8 and 12 can be independently operated for selectively obtaining formation fluid from producing zones 14 and 16. Casing valves 8 and 12 can also be independently operated for selectively delivering stimulation fluids (e.g., matrix acidizing compositions or fracturing fluids) to producing zones 14 and 16.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A method of completing a well having a well bore, said well bore having a well bore wall, said method comprising the steps of:

(a) positioning a conduit in said well bore such that a well bore annulus surrounding said conduit is defined between said conduit and said well bore wall, said well bore annulus having a first longitudinal segment which is positioned within a first producing zone, a second longitudinal segment which is positioned within a second producing zone and is spaced apart from said first longitudinal segment, and a third longitudinal segment which is positioned between said first longitudinal segment and said second longitudinal segment;

(b) placing a gravel pack in said well bore annulus such that said gravel pack surrounds said conduit and said gravel pack substantially fills said first, second, and third longitudinal segments of said well bore annulus whereby said gravel pack includes a first portion located in said first longitudinal segment, a second portion located in said second longitudinal segment, and a third portion located in said third longitudinal segment; and (c) injecting a hardenable hydraulic cement composition into said third portion of said gravel pack such that, after said hydraulic cement composition hardens, said third longitudinal segment of said well bore annulus is blocked and fluid flow through said third longitudinal segment of said well bore annulus from either of said first and second longitudinal segments to the other of said first and second longitudinal segments is thereby substantially prevented.

2. The method of claim 1 wherein said hardenable hydraulic cement composition injected in step (c) is a slurry comprising water and at least one hydraulic cement material and wherein all hydraulic cement material included in said slurry consists essentially of particles having diameters not exceeding 30 microns.

3. The method of claim 2 wherein all hydraulic cement material included in said slurry consists essentially of particles having diameters not exceeding 17 microns.

4. The method of claim 2 wherein said slurry has a water to hydraulic cement weight ratio in the range of from about 0.5 to about 5.0.

5. The method of claim 2 wherein said slurry has a water to hydraulic cement weight ratio in the range of from about 1.0 to about 1.75.

6. The method of claim 2 wherein step (b) includes the steps of:

placing a consolidatable gravel packing composition in said well bore annulus such that said consolidatable gravel packing composition substantially fills said first, second, and third longitudinal segments of said well bore annulus, said consolidatable gravel packing composition comprising a particulate gravel packing material coated with a hardenable resin composition and prior to step (c), allowing said hardenable resin composition to harden such that said consolidatable gravel packing composition forms a hard, permeable mass.

7. The method of claim 6 wherein said particulate gravel packing material consists essentially of particles having sizes of at least as large as 60 mesh.

8. The method of claim 6 wherein said particulate gravel packing material is 20/40 mesh sand.

9. The method of claim 1 wherein:

a first valve is included in said conduit, said first valve comprising a housing having a housing wall, said housing wall having at least one port provided therein, and said first valve further comprising a valve means for selectively opening and closing said port;

said conduit is positioned in said well bore in step (a) such that said first valve is positioned adjacent said third longitudinal segment of said well bore annulus; and said hardenable hydraulic cement composition is injected in accordance with step (c) by delivering said cement composition from said conduit through said port of said first valve.

10. The method of claim 9 wherein:

a second valve is included in said conduit, said second valve comprising a housing having a housing wall, said housing wall having at least one second valve port provided therein, and said second valve further comprising a valve means for selectively opening and closing said second valve port;

a third valve is included in said conduit, said third valve comprising a housing having a housing wall, said housing wall having at least one third valve port provided therein, and said third valve further comprising a valve means for selectively opening and closing said third valve port; and said second and third valves are positioned in said conduit such that, when said conduit is positioned in said well bore in step (a), said second valve is positioned adjacent said first longitudinal segment of said well bore annulus and said third valve is positioned adjacent said second longitudinal segment of said well bore annulus.

11. A method of completing a well, said well having a well bore, said well bore having a highly deviated portion, and said highly deviated portion of said well bore including a well bore wall, said method comprising the steps of:

(a) positioning a conduit in said highly deviated portion of said well bore such that a well bore annulus surrounding said conduit is defined between said conduit and said well bore wall of said highly deviated portion of said well bore, said well bore annulus having a first longitudinal segment which is positioned within a first producing zone, a second longitudinal segment which is positioned within a second producing zone and is spaced apart from said first longitudinal segment, and a third longitudinal segment which is positioned between said first longitudinal segment and said second longitudinal segment;

(b) placing a gravel pack in said well bore annulus such that said gravel pack surrounds said conduit and said gravel pack substantially fills said first, second, and third longitudinal segments of said well bore annulus whereby said gravel pack includes a first portion located in said first longitudinal segment, a second portion located in said second longitudinal segment, and a third portion located in said third longitudinal segment; and (c) injecting a hardenable hydraulic cement composition into said third portion of said gravel pack such that, after said hydraulic cement composition hardens, said third longitudinal segment of said well bore annulus is blocked and fluid flow through said third longitudinal segment of said well bore annulus from either of said first and second longitudinal segments to the other of said first and second longitudinal segments is thereby substantially prevented.

12. The method of claim 11 wherein said hardenable hydraulic cement composition injected in step (c) is a slurry comprising water and at least one hydraulic cement material and wherein all hydraulic cement material included in said slurry consists essentially of particles having diameters not exceeding 30 microns.

13. The method of claim 12 wherein said highly deviated portion of said wellbore is substantially horizontal.

14. The method of claim 12 wherein said slurry has a water to hydraulic cement weight ratio in the range of from about 1.0 to about 1.75.

15. The method of claim 12 wherein step (b) includes the steps of:

placing a consolidatable gravel packing composition in said well bore annulus such that said consolidatable gravel packing composition substantially fills said first, second, and third longitudinal segments of said well bore annulus, said consolidatable gravel packing composition comprising a gravel packing particulate material coated with a hardenable resin composition and prior to step (c), allowing said hardenable resin composition to harden such that said consolidatable gravel packing composition forms a hard, permeable mass.

16. The method of claim 15 wherein said highly deviated portion of said wellbore is substantially horizontal.

17. The method of claim 15 wherein said gravel packing particulate material consists essentially of particles having sizes of at least as large as 60 mesh.

18. The method of claim 11 wherein:

a first valve is included in said conduit, said first valve comprising a housing having a housing wall, said housing wall having at least one port provided therein and said first valve further comprising a valve means for selectively opening and closing said port;

said conduit is positioned in said well bore in step (a) such that said first valve is positioned adjacent said third longitudinal segment of said well bore annulus; and said hardenable hydraulic cement composition is injected in accordance with step (c) by delivering said cement composition from said conduit through said port of said first valve.

19. The method of claim 18 wherein:

a second valve is included in said conduit, said second valve comprising a housing having a housing wall, said housing wall having at least one second valve port provided therein and said second valve further comprising a valve means for selectively opening and closing said second valve port;

a third valve is included in said conduit, said third valve comprising a housing having a housing wall, said housing wall having at least one third valve port provided therein and said third valve further comprising a valve means for selectively opening and closing said third valve port; and said second and third valves are positioned in said conduit such that, when said conduit is positioned in said well bore in step (a), said second valve is positioned adjacent said first longitudinal segment of said well bore annulus and said third valve is positioned adjacent said second longitudinal segment of said well bore annulus.

20. The method of claim 19 wherein said highly deviated portion of said wellbore is substantially horizontal.

* * * * *